US005867922A

United States Patent [19]

Hull et al.

[11] Patent Number: 5,867,922

[45] Date of Patent: Feb. 9, 1999

[54] NOISE REDUCING FOOTWEAR

[75] Inventors: Martin Philip Hull, Menlo Park, Calif.; Clay William Tippins, Milburn, Ga.

[73] Assignee: Zoomers, San Carlos, Calif.

[21] Appl. No.: 807,446

[22] Filed: Feb. 28, 1997

[51] Int. Cl.[6] ..... A43C 15/02

[52] U.S. Cl. ..... 36/7.5; 36/116; 36/7.6

[58] Field of Search ..... 36/113, 115, 116, 36/132, 7.6, 7.5, 7.1 R, 123, 124

[56] References Cited

U.S. PATENT DOCUMENTS

| | | | |
|---|---|---|---|
| 23,480 | 4/1859 | McConnell | 36/7.5 X |
| 288,653 | 11/1883 | Morgan | 36/7.6 |
| 620,582 | 3/1899 | Goff | 36/7.6 |
| 887,752 | 5/1908 | Beck et al. | 36/7.5 |
| 1,435,538 | 11/1922 | Lumbard | 36/7.5 |
| 2,588,801 | 3/1952 | Brunet | 36/7.5 |
| 3,494,055 | 2/1970 | McSorley | 36/134 X |
| 3,786,579 | 1/1974 | Clark et al. | 36/7.6 |
| 5,533,277 | 7/1996 | Bell et al. | 36/7.6 |

FOREIGN PATENT DOCUMENTS

| | | |
|---|---|---|
| 5188 | 10/1891 | United Kingdom . |
| 14353 | 6/1903 | United Kingdom . |
| 2136268 | 9/1984 | United Kingdom . |

*Primary Examiner*—Ted Kavanaugh
*Attorney, Agent, or Firm*—Peninsula IP Group; Douglas A. Chaikin

[57] ABSTRACT

Disclosed herein is environmentally compatible footwear attachable apparatus for reducing noise caused by a foot walking on ground. The environmentally compatible footwear attachable apparatus includes a frame attachable to the foot, an adjustment member, an attachment member and support members. The support members have a tapered portion, a top portion and a base. The base penetrates ground. The tapered portion displaces the ground. The top portion supports the frame above the ground. When the base penetrates the ground, the tapered portion displaces the ground to reduce noise made by walking.

46 Claims, 8 Drawing Sheets

NOISE REDUCING FOOTWEAR

BACKGROUND OF THE INVENTION

1. Field of the Invention

This invention relates to environmentally compatible footwear. More particularly, this invention relates to footwear designed to alter noise made by walking.

2. Previous Art

Hunters, photographers and nature enthusiasts often enjoy observing wildlife such as deer, wolves, birds and other animals. At close distances, observing wildlife can bring an observer great pleasure. To the trained observer, the subtle movements made by wildlife in a natural habitat can reveal artistic grace and beauty. A deer grazing in a clearing, a wolf wandering, and a bird feeding its young often provide the observer with artistic impression not found in a photograph, for example.

Nature observers, hunters and naturalists face challenges. Typically, walking and hiking makes noise which frightens wildlife. Deer for example, are believed to distinguish predators from non-predators by the noises made during movement. When a hiker's foot contacts the earth, the surface of the ground can shift, leaves can rustle and twigs can snap. This makes noise which alerts the deer to the presence of a human. The alerted deer will typically run to avoid potential danger.

Noise made by humans is distinguishable from noise made by other creatures. For example, a hopping rodent makes a brisk noise of short duration with each hop. A hoofed animal such as a deer steps cautiously and makes a quieter noise having a relatively longer duration. A human can make a crunching noise with each footstep because the surface area of a human foot is relatively larger than the surface area of the feet of many wild creatures.

The ground includes a broad range of material including soil. Soil is a mixture of organic and inorganic materials. The soil may also include a surface layer of organic material such as leaves, branches, twigs, small plants and brush. Inorganic material can include rocks, stones, sand, dirt and mud. For the purposes herein, the term "ground" is to be broadly understood to include various soils having surface layers and both organic and inorganic materials. The ground can be located anywhere including a wooded area, a rain forest, desert, mountainside or even a lunar-like surface. The make-up of the ground may vary depending upon composition and moisture content. Hard rock, compacted gravel, and gravel may be able to support hundreds of pounds of bearing force per square inch, whereas softer soils may only be able to support a few pounds per square inch.

Hiking in wooded areas (e.g. a hardwood forest) is particularly noisy because the soil has a covering of leaves, small twigs, pieces of bark, and branches. Leaves fall randomly to the forest floor, forming a loose mesh. If one were to walk over this mesh bare foot, or with normal shoes or boots, the mesh would be crushed between the foot and the floor, resulting in significant noise from the crushing of leaves and the cracking of branches and twigs.

Modifying the contact surface of the human foot alters noise produced by movement over the ground. For example, walking on the ball of the foot and the toes (i.e. tiptoe) alters the noise made by walking. Walking on tiptoe is believed to be a quieter method of travel than normal walking. Walking on tiptoe, however, is uncomfortable for walking for extended periods and over long distances.

Hunters and photographers, in particular, are challenged to disguise their presence in order to avoid frightening wildlife to be observed. A photographer's presence can be disguised by reducing the amount of noise made, and by altering noise made. Some disguise their presence by remaining stationary and silent. Silence is nearly achieved through the use of stationary stands such as tree stands. In this way, extensive hiking is avoided and noise is minimized. Unfortunately, game and other wildlife are not always visible from a tree stand. A person can make noise and be heard while approaching a stationary stand. What is desired is a better way of disguising the presence of a person.

Nature enthusiasts do not always rely on stationary stands. Many simply hike through the wilderness and look for wildlife. Because hiking makes noise which scares deer, wolves, wildcats and the like, these creatures often retreat prior to being observed by a hiker. What is desired is a way of moving through the wilderness without scaring wildlife to facilitate observation of the wildlife.

SUMMARY AND OBJECTS OF THE INVENTION

It is an object of the invention to provide footwear which alters noise made by human movement over ground.

It is a further object of this invention to provide footwear which can be used in the wilderness to reduce noise made by walking.

It is a further object of this invention to provide footwear which adjusts to the foot of a person.

It is a further object of the present invention to provide a footwear attachable apparatus which allows one's weight to be supported by the floor, and which does not compress the loose mesh enough to crush or to crack the constituent elements (leaves, twigs, pieces of bark, branches, and the like) of the mesh.

In accordance with the aforementioned objects and those that will be mentioned and will become apparent below, the footwear attachable apparatus, according to one embodiment of the present invention comprises:

- a frame, the frame being attachable to a user's footwear;
- a plurality of support members affixed to the frame, the plurality of support members supporting the frame above ground, each of the plurality of support members including:
  - a base surface;
  - a top surface affixed to said frame, said top surface having a surface area greater than a surface area of said base surface;
  - at least one upper side surface; and
  - at least one tapered surface between the base surface and the upper side surface, the tapered surface meeting the base surface and forming an interior and an exterior support member edge relative to the frame, at least two of the support members being affixed to the frame such that a center of rotation of the user's ankle is aligned with both an exterior edge of the user's footwear and the support member exterior edge.

In another preferred embodiment, the tapered surface forms an angle, relative to the longitudinal axis of the support member, which has a magnitude at least sufficient to maintain the frame above ground when the frame supports a user's weight.

In yet another preferred embodiment, the tapered surfaces of the support member form an angle of about 30°, relative to the longitudinal axis of the support member.

According to another preferred embodiment, both the surface area of the base surface and the angle of the tapered surfaces relative to the longitudinal axis of the support members are selected to maintain the frame above ground when the frame supports the user's weight.

According to a further preferred embodiment of the present invention, the tapered surfaces of the support members form an angle relative to a longitudinal axis of the support members, an area of the base surface and this angle being selected such that the product of the bearing strength of the ground and the sum of a cross-sectional area, taken along the tapered surface, of each of the support members, is at least equal to a user's weight, as the support member penetrates to the ground when the frame supports the user's weight. The cross-sectional area corresponds to a cross-sectional area of the support member immediately above ground and substantially parallel to the frame.

According to yet a further preferred embodiment of the present invention, four support members are affixed to the frame.

In another preferred embodiment, the support members are removeably affixed to the frame.

According to a still further preferred embodiment, the footwear attachable apparatus of the present invention includes at least one spacer, the spacer being removeably attachable to the frame and having a width sufficient to allow the user's footwear to be securely attached to the frame.

In a still further preferred embodiment, the frame comprises a front and a rear portion, the front and rear portions being adjustably secured to one another by a plurality of fasteners to vary the length of the frame.

According to still further preferred embodiments, the base surface can have a rectangular, substantially circular, substantially semi-circular, trapezoidal, or triangular shape. Moreover, the base surface may have an arcuate periphery which defines at least a portion of an ellipse.

In still further preferred embodiments, each of the plurality of support members comprises four tapered surfaces.

According to another preferred embodiment, each of the plurality of support members comprises a single curved tapered surface forming a frusto-conical shape.

In further preferred embodiments, a cleat is removeably attached to each of the plurality of support members.

In still further preferred embodiments of the present invention, the support members may be hollow, or solid, and made from rugged, corrosion resistant material such as metal, plastics, or composite materials.

BRIEF DESCRIPTION OF THE DRAWING

For a further understanding of the objects and advantages of the present invention, reference should be given to the following detailed description, taken in conjunction with the accompanying drawings, in which like parts are given like reference numerals and wherein.

DETAILED DESCRIPTION OF THE PREFERRED EMBODIMENTS

To support the user's weight on the ground, the footwear attachable apparatus of the present invention must cover enough of the floor surface area so that a product of the number of square inches of floor covered by the weight bearing elements and the bearing strength of the floor per square inch is at least equal to the weight of the user.

To successfully alter or reduce the noise of human footsteps on, for example, a forest floor, it is necessary to penetrate the mesh covering the forest floor without, however, crushing or cracking of the mesh elements. To do so, the leading surface, or tip of any bearing member of such a device must have a surface area small enough to penetrate in between the constituent mesh elements of the loose mesh covering the forest floor, and then to penetrate the loose mesh elements without trapping these elements between the bearing member and the floor.

On floors having extremely high bearing strength, a device equipped with several thin vertical posts would keep the users supported above the mesh, and would easily penetrate to the high bearing strength floor without crushing or cracking the mesh.

The floors in most setting where vegetation grows do not have extremely high bearing strengths. Such a device equipped with a plurality of thin vertical posts would then sink into the floor, thereby loudly crushing and cracking the mesh. However, by equipping the footwear attachable apparatus with weight bearing support members having a surface area small enough to penetrate and to separate the mesh, and tapered sides which increase the bearing surface area of the support member as it presses further into the floor alleviates this problem. Such weight bearing support members will then press into the floor under the force of the user's weight, until the floor surface area covered by the support member is sufficient to support the weight of the user.

Figure 1:
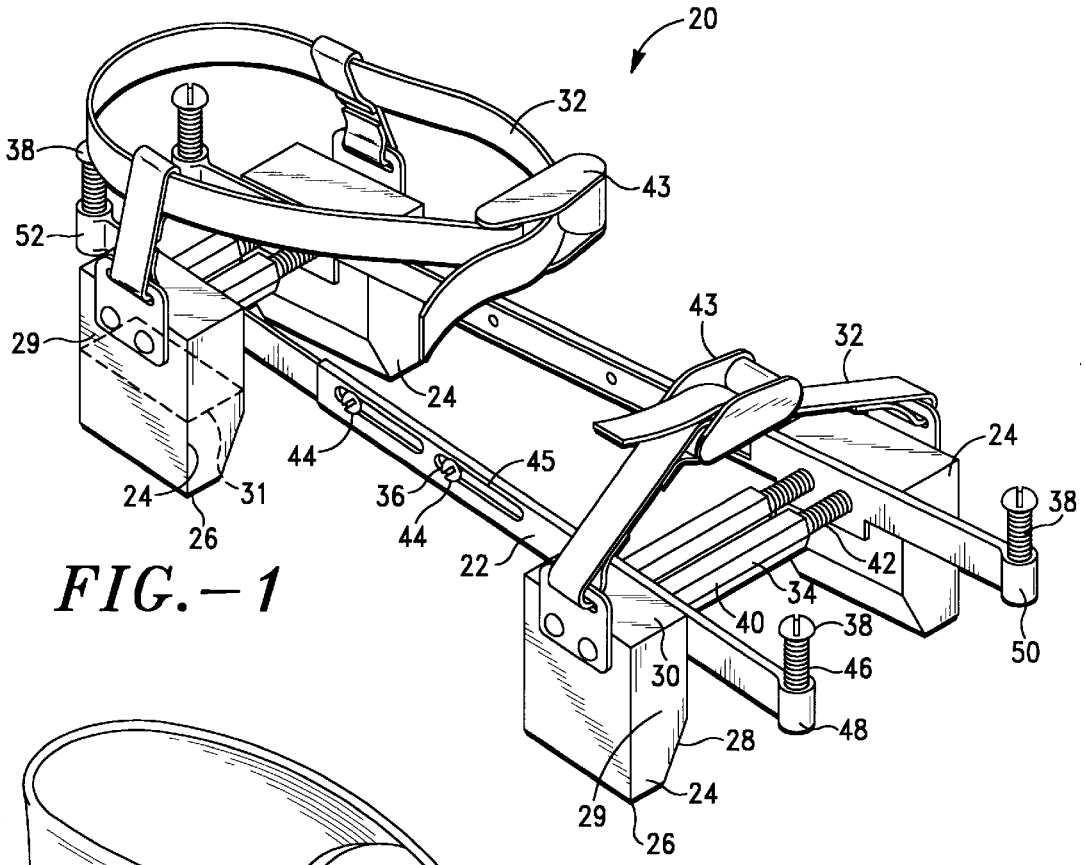
FIG. 1 is a perspective view of footwear in accordance with the present invention.

Turning now to a first embodiment of the present invention, with particular reference to FIG. 1, there is shown a footwear attachable apparatus generally designated with the reference numeral 20. The footwear attachable apparatus 20 is environmentally compatible. The footwear 20 includes a frame 22, and support members 24. The support members 24 include a base 26, a tapered portion 28, and a top portion 29. The frame 22 includes straps 32, width spacers 34, length adjustment assembly 36 and end restraints 38.

The top portion 29 has a cross-section 31 and a top surface 30.

The width spacers 34 include a rotatable member 40 and a threaded member 42. The rotatable member 40 rotatably attaches to the threaded member 42 to selectively regulate the width of the frame 22.

The straps 32 attach to the frame 22 via the support members 24. The straps 32 include an adjustable buckle 43. The buckle 43 adjusts the straps 32 for attachment to the foot of a user.

The length adjustment assembly 36 includes a screw 44 and an adjustable portion 45 with an adjustable length. The screw 44 is selectively adjustable to selectively lock the length of the adjustable portion 45.

The height adjuster 38 includes a screw 46. The frame 22 has a front 50 and a rear 52. A pair of screws 46 attach to the frame 22 at the front 50 and at the rear 52 to hold the foot of a user against the frame 22. Each height adjuster 38 is adjustable in height, to thereby adjust to the user's footwear. Each height adjuster 38 also functions as an end restraint, to restrain both the front and rear of the user's footwear, and to securely attach the user's shoe or boot to the footwear 20.

Figure 2:
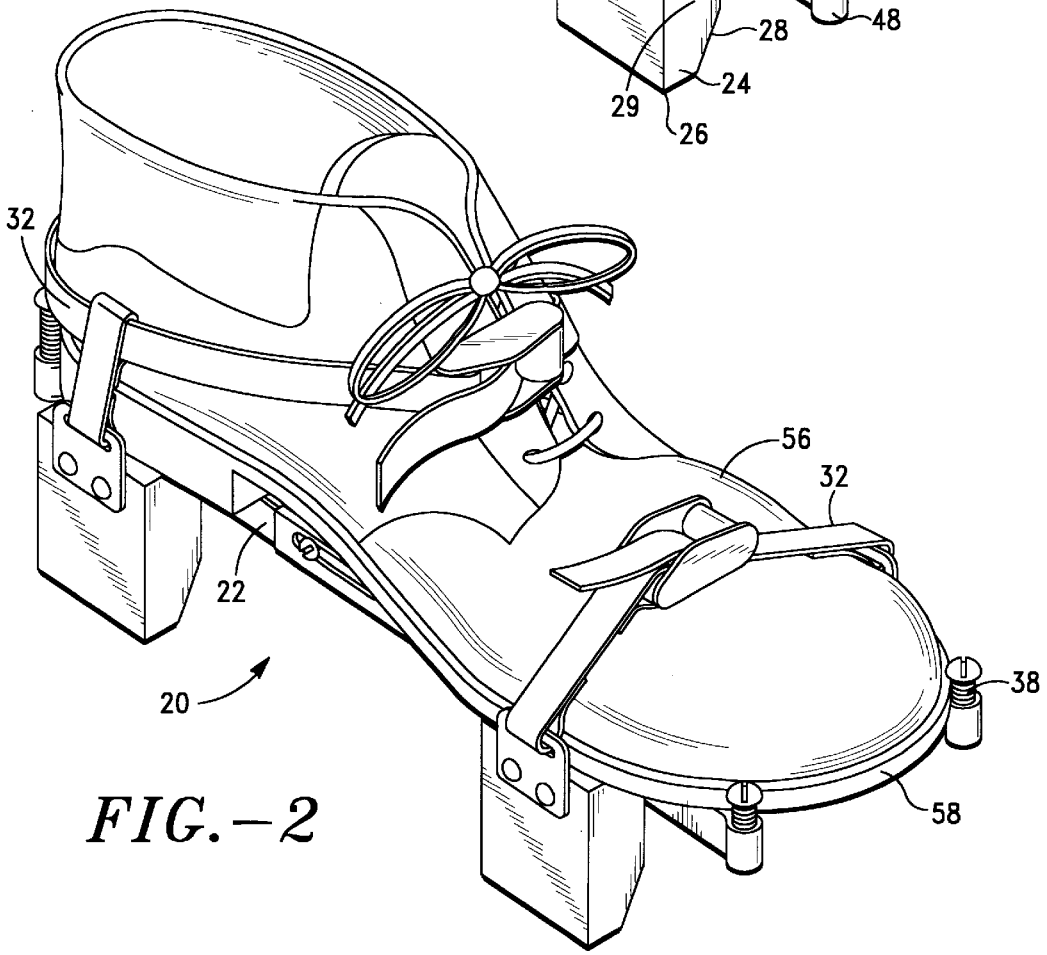
FIG. 2 is a perspective view of the footwear of FIG. 1 attached to a boot.

With particular reference to FIG. 2 there is shown the footwear generally designated with the reference numeral 20. The straps 32 attach the frame 22 to the boot 56. The boot 56 has a sole 58. The end restraints 38 adjustably attach to the sole 58 of the boot 56 to secure the boot 56 to the frame 22. It can be appreciated that the foot of a user is insertable into the boot 56 to accommodate the user during hiking and walking, for example.

Figure 3:
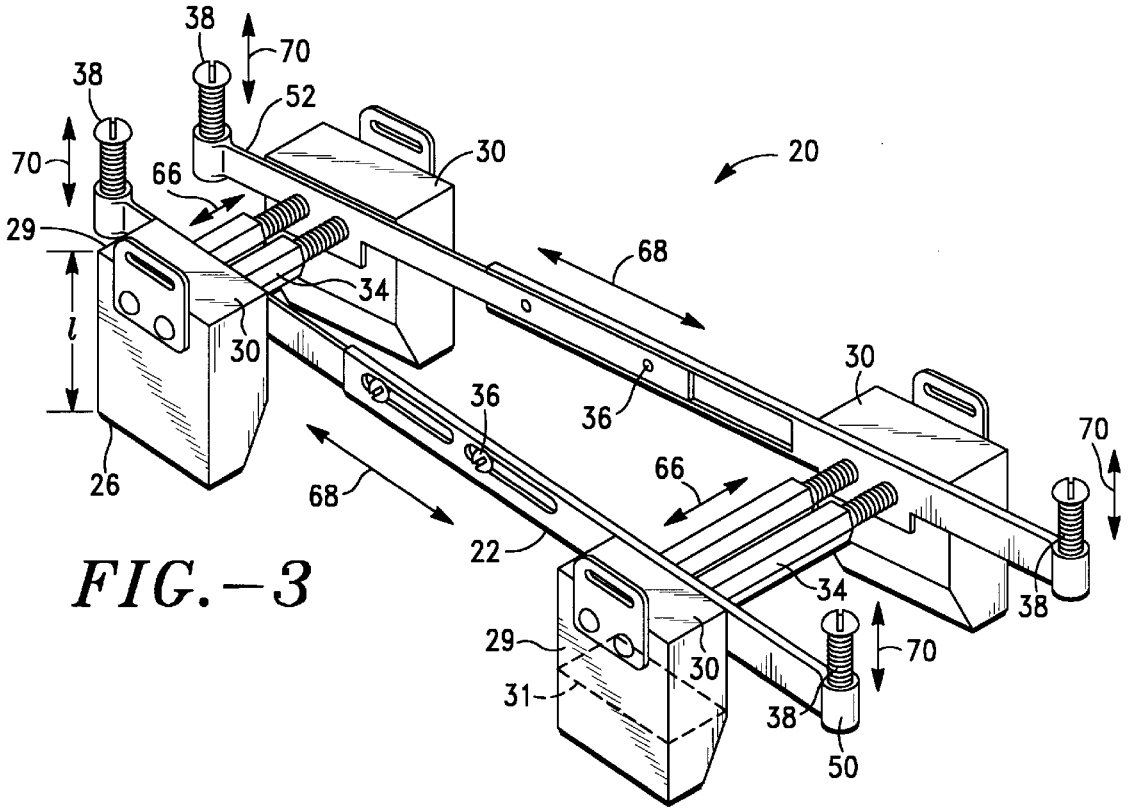
FIG. 3 is a perspective view of footwear in accordance with the present invention.

With particular reference to FIG. 3, there is shown the frame 22. The arrows 66, 68 and 70 respectively show directions in which the width spacers 34, length adjustment assembly 36 and end restraints 38 respectively adjust the frame 22. Each width spacer 34, length adjustment assembly 36 and end restraint 38 is independently adjustable.

The width spacers 34 are adjusted to cause the front 50 of the frame 22 to be relatively wider than the rear 52 of the frame 22. The relatively greater width of the front 50 with respect to the rear 52 stabilizes the frame 22. The width spacers 34 adjust to conform the width of the frame 22 with the shape of the foot of a user. When the foot has a boot 56 (FIG. 2), the width spacers 34 adjust the width of the frame 22 to the width of the boot 56.

In one embodiment, each support member has length l within the range of 1.5 inches to 3.5 inches. The length l extends perpendicularly from the frame 22 between the top portion 29 and the base 26. The cross-section 31 is defined on a plane parallel with the frame 22 and perpendicular to the length l. The cross-section 31 of the top portion 29 has an area sufficient to support the frame 22 above ground.

Figure 4:
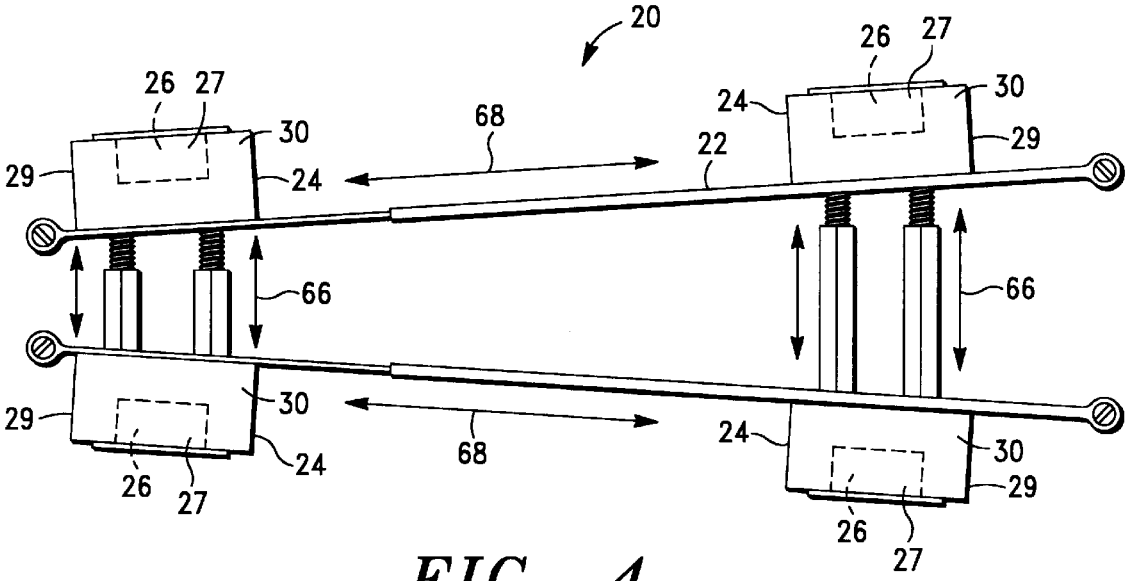
FIG. 4 is a top view of the footwear of FIG. 3 showing a variation of the base in accordance with the present invention.

With particular reference to FIG. 4, there is shown the footwear attachable apparatus generally designated with the reference numeral 20. The footwear attachable apparatus 20 includes four support members 24. Each support member 24 has a top portion 29 and a base 26. Each base 26 has a surface 27 with a surface area. Each top portion 29 has a cross-section 31 (FIG. 3) with an area within the range of 1.5 square inches to 2.5 square inches. The surface area of the base 26 is within the range of 0.25 square inches to 1.0 square inch. The top surface 30 has an area which equals the area of the cross-section 31 (FIG. 3) of the top portion 29.

In one embodiment, multiple support members 24 attach to the frame 22. The support members 24 have respective bases 26. The surfaces 27 of the bases 26 have an aggregate area within the range of 1.0 square inch to 4.0 square inches. The support members 24 have respective top portions 29. Each top portion 29 has a cross-section 31. The aggregate area of the cross-sections 31 is within the range of 6 square inches to 10 square inches. The top surface 30 has a surface area which equals the area of the cross-section 31 of the top portion 29.

In each embodiment described with reference to FIG. 4, the cross-sectional areas of the top portions 29 and of the bases 26 respectively are defined on a plane substantially parallel with the frame 22 and substantially perpendicular to the length/(FIG. 3).

Figure 5:
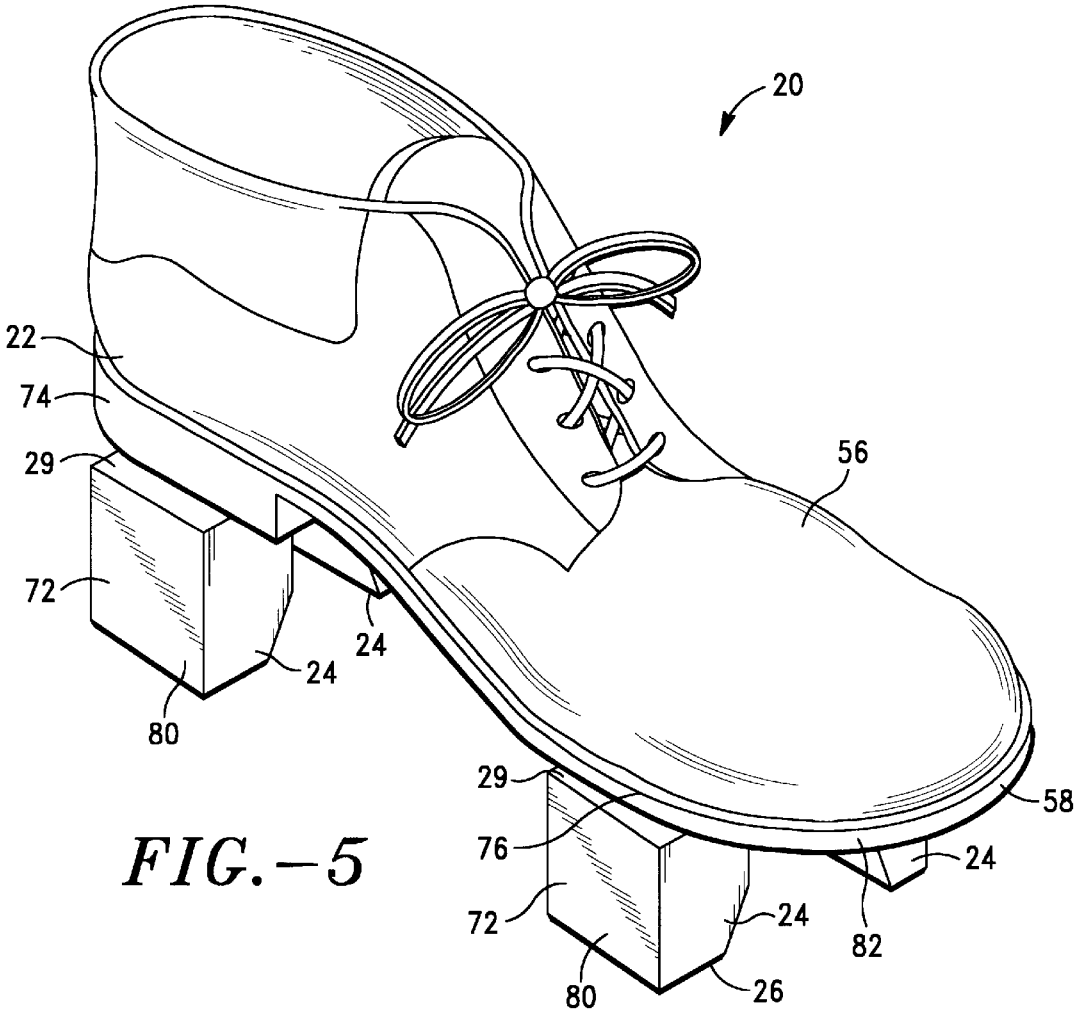
FIG. 5 is a perspective view of footwear in accordance with the present invention.

With particular reference to FIG. 5, there is shown the footwear attachable apparatus generally designated with the reference numeral 20. The footwear includes a boot 56 and four support members 24. The boot 56 includes a sole 58. The sole 58 has a heel 74, a toe 82 and a periphery 76. A pair of support members 24 attach to the heel 74 and another pair of support members attach to the toe 82. The support members 24 have a portion which extends outwards from the periphery 82 to broadly support the sole 58. The toe 82 includes the portion of the sole 58 which is designed to support the ball of a users foot. Accordingly, during use, the ball of the user's foot aligns vertically above one pair of support members 24.

Each support member 24 has a top portion 30 (as shown in FIG. 4)and a flat surface 80. The top portion 29 attaches to the sole 58. The flat surface 80 extends substantially perpendicularly from the bottom surface of the sole 58 to the base 26. The flat surface 80 faces outward from the periphery 76 of the sole 58 and extends between the top portion 29 and the base 26.

The support members 24 may be fabricated from wood, hard rubber, thermoplastic material, composites or other suitable materials. The support members 24 may have a protective coating 72. The protective coating 72 may include paint, or other sealant material.

In one embodiment, the support members 24 removeably attach to the sole 58 to ease movement on hard surfaces such as pavement, rock or cement. The support members 24 removably attach to the sole 58 to ease replacement when the support members 24 become worn. Removable attachment of the support members 24 to the sole 58 can be accomplished with screws or other mechanical fasteners, for example.

It can be appreciated that the support member 24 can attach to the sole 58 in any of a number of ways. For example, the support members 24 can adhesively attach to the sole 58. The boot 56 is to be broadly understood to include ordinary shoes, slippers having a semi-rigid sole, and any type of outdoor footwear.

Figure 6:
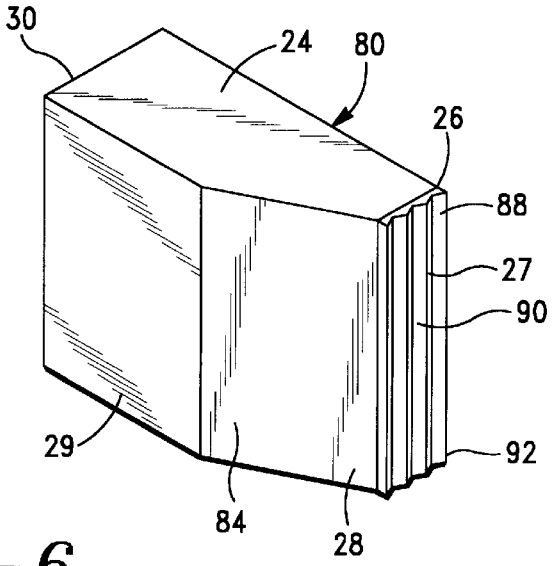
FIG. 6 is a perspective view of the support member of FIG. 5.

With particular reference to FIG. 6 there is shown a support member 24. The support member 24 has top portion 29, a base 26, a flat surface 80 and a tapered portion 28. The tapered portion 28 has a planar tapered surface 84. The flat surface 80 extends from the top surface 30 to the base 26. The planar tapered surface 84 opposes the flat surface 80 at a desired angle.

The base 26 may include a textured surface 88. The textured surface 88 includes a resilient piece 90 which covers the base 26 and is adhesively joined with he base 26. The textured surface 88 improves traction of the support member 24 on hard surfaces such as pavement, rock and cement and further reduces noise.

Figure 7:
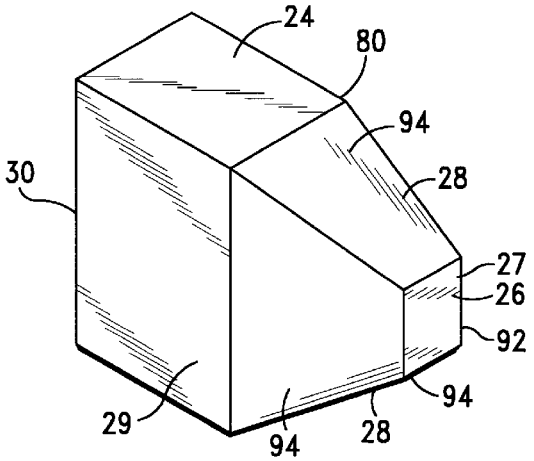
FIG. 7 is a perspective view of a variation of the support member of FIG. 6.

With particular reference to FIG. 7, there is shown a support member 24. The support member includes the top portion 29 with a top surface 30, the tapered portion 28, the flat surface 80 and the base 26. The tapered portion 28 includes three tapered planar surfaces 94. The base 26 has a periphery 92 which is rectangular in shape.

Figure 8:
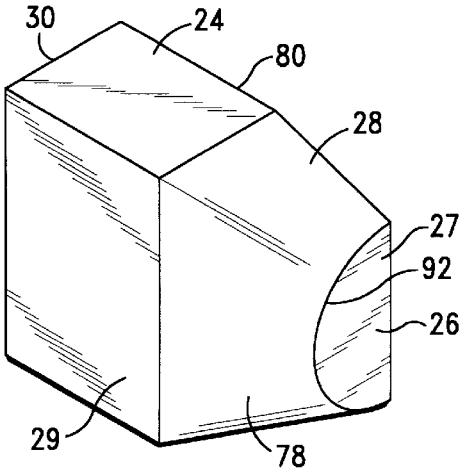
FIG. 8 is a perspective view of a variation of the support member of FIG. 6.

With particular reference to FIG. 8, there is shown a support member 24. The support member 24 has a top portion 29 with a top surface 30, a tapered portion 28 and a base 26 and a flat surface 80. The tapered portion 28 has a curved surface 78. The base 26 has an arcuate periphery 92. The flat surface 80 extends at a right angle from the top surface 30 to the base 26. The curved surface 78 circumscribes part of the tapered portion 28 and extends from the top portion 29 to the base 26 and defines a part of the arcuate periphery 92.

Figure 9:
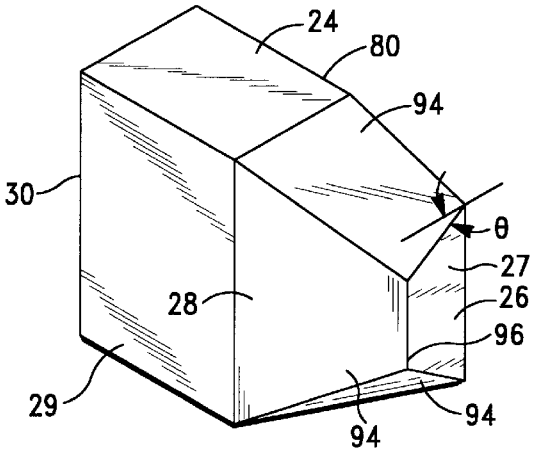
FIG. 9 is a perspective view of a variation of the support member of FIG. 6.

With particular reference to FIG. 9, there is shown a support member 24. The support member 24 has a top portion 29 with a top surface 30, a tapered portion 28, a base 26 and a flat surface 80. The tapered portion 28 has three tapered surfaces 94. The top surface 30 is configured to lie substantially parallel with the sole of a user's boot. The base 26 lies in a plane at an acute angle Θ with respect to the top surface 30. The base 26 has a trapezoidal shape and a leading edge 96. The leading edge 96 is configured to penetrate the ground.

In one embodiment of the support member 24 in FIG. 9, the base 26 is substantially parallel to the top portion 30. The flat surface 80 is rectangular in shape and extends substantially perpendicularly from the top surface 30 to the base 26.

Figure 10:
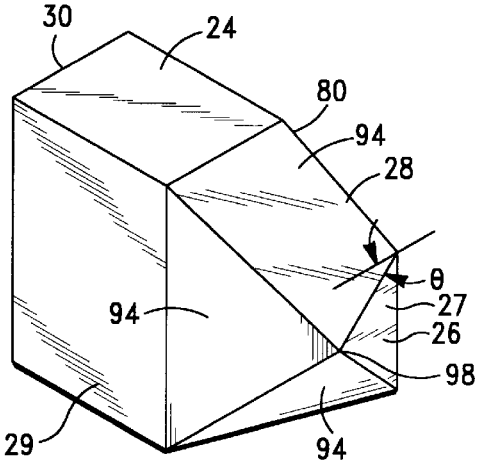
FIG. 10 is a perspective view of a variation of the support member of FIG. 6.

With particular reference to FIG. 10, there is shown a support member 24. The support member 24 has a top portion 29 with a top surface 30, a tapered portion 28, a base 26 and a flat surface 80. The tapered portion 28 has three tapered surfaces 94. The top surface 30 is configured to lie substantially parallel with the sole of the boot of a user. The base 26 lies in a plane at an acute angle Θ with respect to the top surface 30. The base 26 has a leading point 98. The leading point 98 is configured to penetrate the ground.

In one embodiment of the support member of FIG. 10, the base 26 is substantially parallel to the top surface 30. The flat surface 80 is rectangular in shape and extends substantially perpendicularly from the top surface 30 to the base 26.

Figure 11:
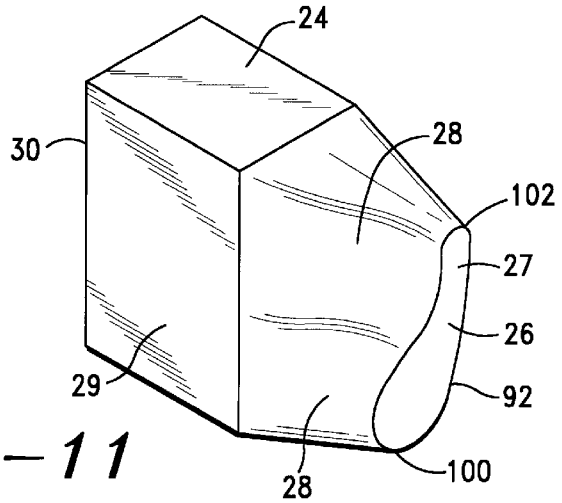
FIG. 11 is a perspective view of a variation of the support member of FIG. 6.

With particular reference to FIG. 11, there is shown a support member 24. The support member 24 has a top portion 29 with a top surface 30, a tapered portion 28, a base 26. The base 26 has an arcuate periphery 92. The base 26 has a leading portion 100 and a trailing portion 102. The leading portion 100 and the trailing portion are each generally elliptical in shape where the leading portion 100 has a larger elliptical diameter and a larger surface area than the trailing portion 102. Accordingly, the shape of the base 26 and the tapered portion 28 generally resembles the shape of a deer hoof.

Figure 12:
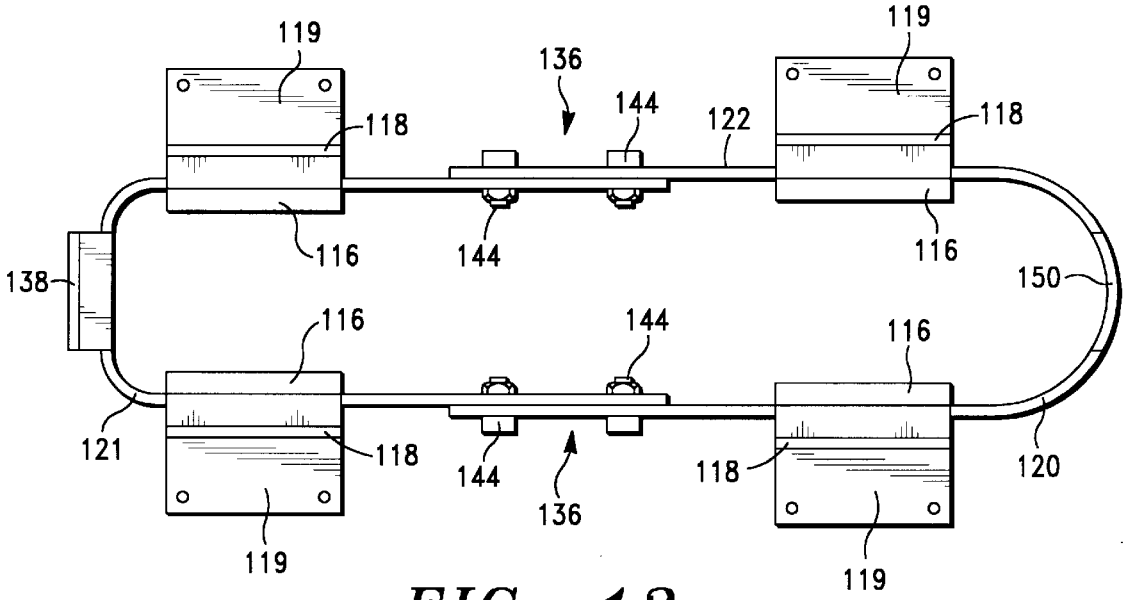
FIG. 12 is a top view of the footwear attachable apparatus according to the present invention.
Figure 13:
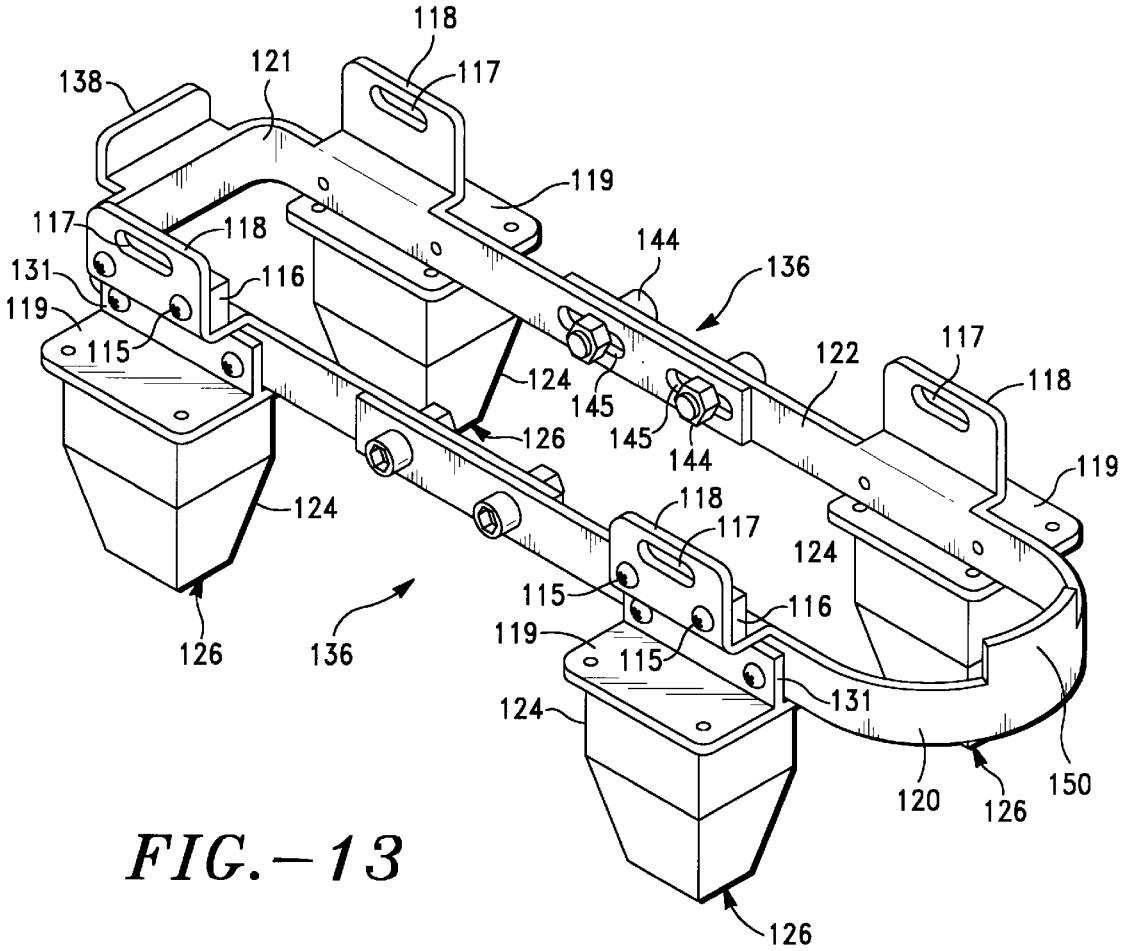
FIG. 13 is a perspective view of the footwear attachable apparatus of FIG. 12.

FIGS. 12 and 13 show a top and perspective view, respectively, of another embodiment of the present invention. The frame 122 is constituted by a front frame portion 120 and a rear frame portion 121. The front and rear frame portions are adjustably secured to one another by a plurality of fasteners 144 inserted through the slotted adjustment portion 145 of both the front frame portion 120 and the rear frame portion 121. The fasteners 144, the adjustment portions 145 together form the frame length adjustment assembly 136 which allows the length of the frame to be adjusted to fit a particular user's footwear. The frame 122 further comprises raised portions 150 and 138 which are front and rear footwear restraint portions, respectively. Together, the front and rear foot restraining portions restrict the movement of the user's footwear in the longitudinal direction of the frame 122.

Attached to the frame 122 are a number of attachment brackets 131, each of which having a top surface 119 to which a support member 124 is affixed. The frame 122 also comprises a plurality of strap securement members 118 each comprising a strap attachment slot 117 through which straps similar to those shown in FIG. 1 may be attached, in order to secure the footwear apparatus to the user's own footwear. For clarity, the straps themselves are not shown in either FIGS. 12 or 13.

Figure 17:
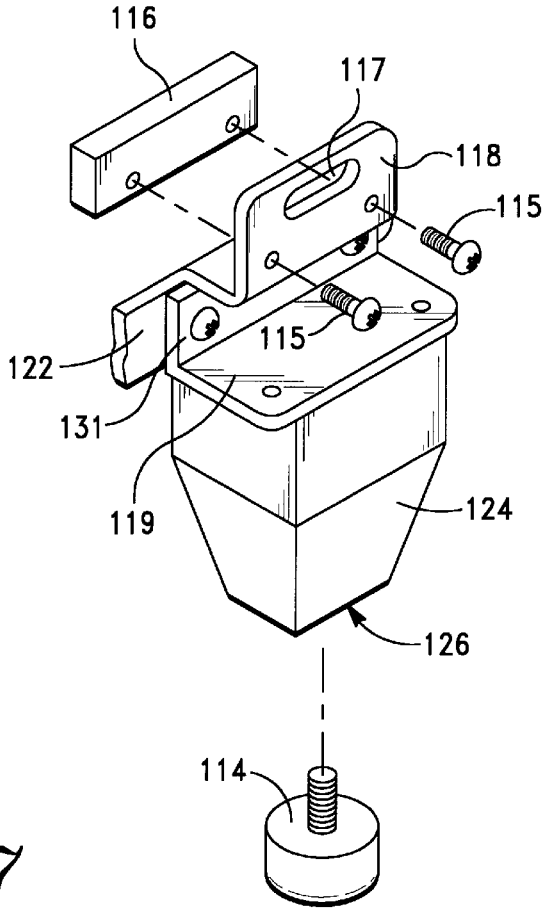
FIG. 17 shows an exploded perspective view of a support member, cleat and spacer according to the present invention.

FIG. 12 shows four spacers 116, which four spacers are removeably attachable to the frame 122. The spacers 116 have a width which is sufficient to allow the user's footwear to be securely attached to the frame and to minimize the play of the user's footwear in a direction perpendicular to the longitudinal direction of the frame 122. Spacers 116 having different widths are selectively used, to conform to the width of the user's footwear. For clarity, FIG. 13 only shows two such spacers 116 removeably attached to the straps securement members 118. The spacers 116 are attached to the straps securement members 118 by means of spacer fasteners 115, as also shown in FIG. 17.

The support members 124 each have a bottom base surface 126 having a shape and dimensions suitable to contact and to penetrate the ground. Under most conditions, it was found that a base surface area of between ½ square inch and 1 square inch successfully penetrated and separated the mesh.

Figure 14:
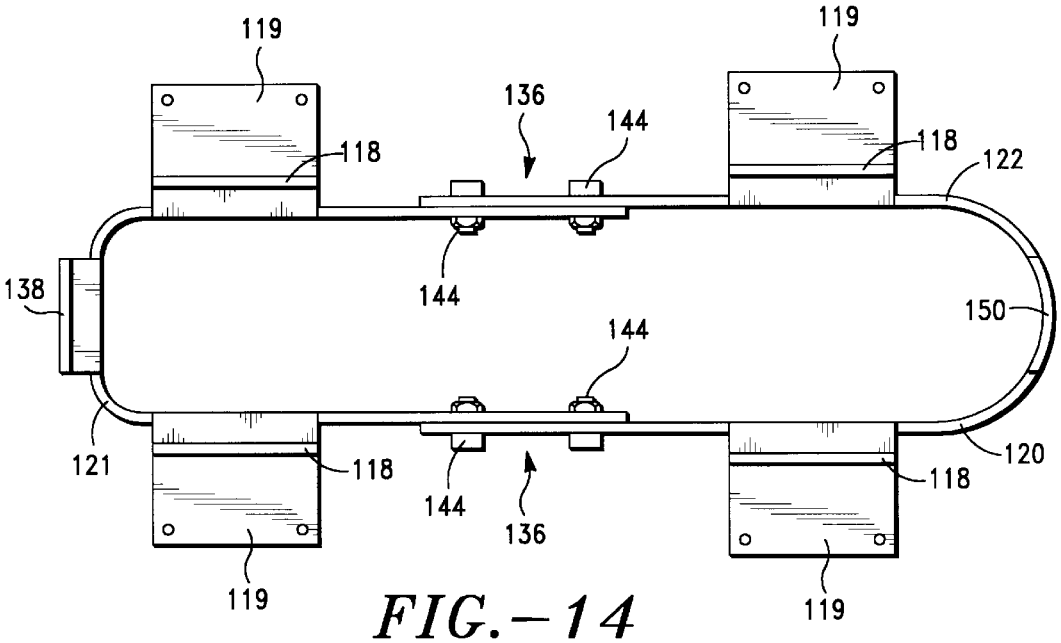
FIG. 14 is a top view of a further embodiment of the footwear attachable apparatus according to the present invention.
Figure 15:
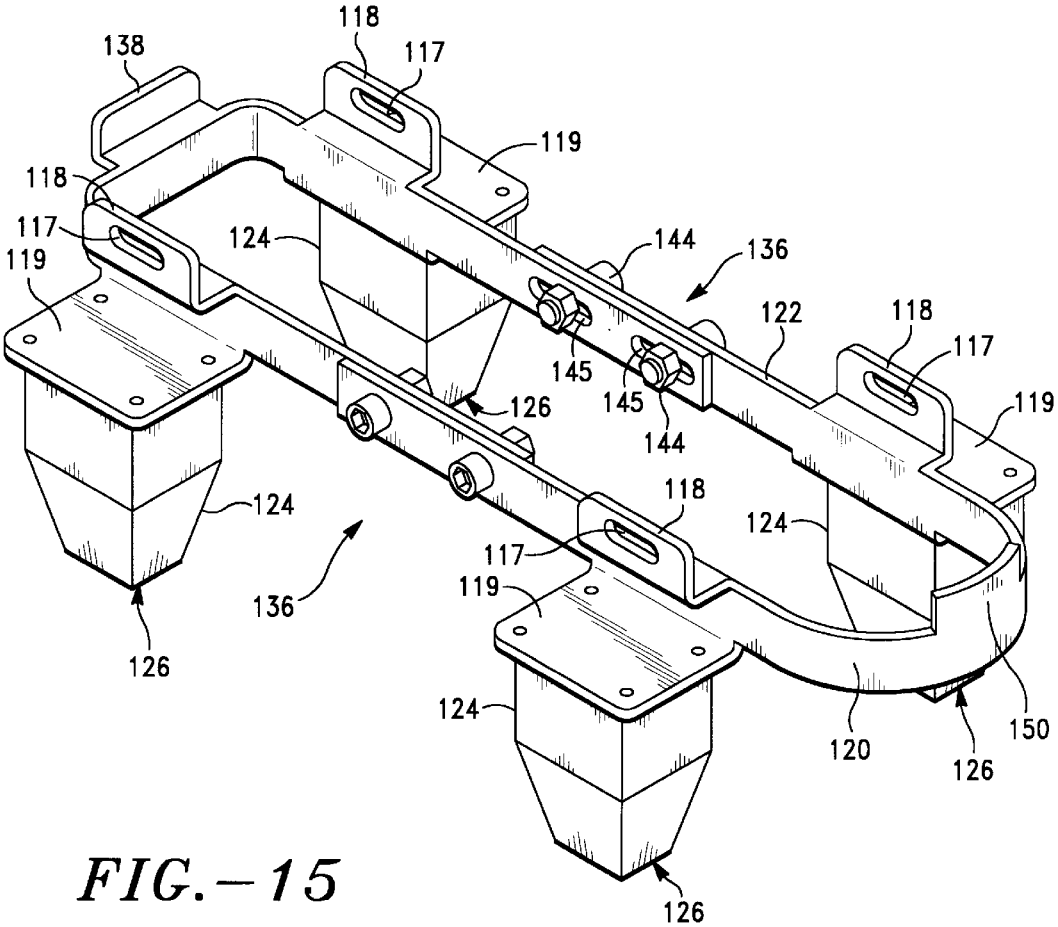
FIG. 15 is a perspective view of the footwear attachable apparatus shown in FIG. 14.

FIGS. 14 and 15, respectively, show a top view and a perspective plan view of yet another embodiment of the present invention. The embodiment illustrated in FIGS. 14 and 15 are similar to that illustrated in FIGS. 12 and 13. However, in FIGS. 14 and 15, the top surface 1 19 to which the support members 124 attach, are integrally formed with the frame 122. More particularly, in FIGS. 14 and 15, the two top surfaces 119 closest to the front restraint 150 are integrally formed with the front portion of the frame assembly 120, whereas the two top surfaces 119 closest to the rear restraint 138 are integrally formed with the rear portion 121 of the frame assembly 122. Spacers, such as the spacers 116 shown in FIGS. 12 and 13 have been omitted, for clarity, from both FIGS. 14 and 15. However, it is to be understood that such spacers can be easily used in this embodiment.

Figure 16:
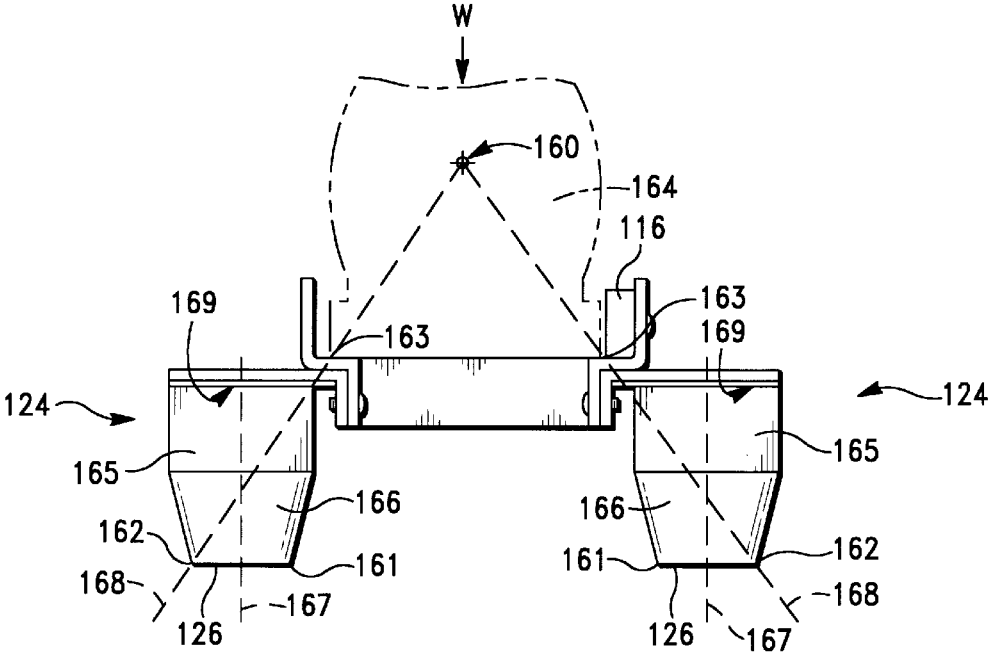
FIG. 16 shows a rear view of the footwear attachable apparatus according to the present invention.

FIG. 16 shows a rear view of the footwear attachable apparatus according to the present invention. Reference numeral 164 designates a user's footwear, shown in broken lines. The legend "W" above the vertical arrow, in FIG. 16, schematically represents the direction of the force exerted by the user's weight bearing against the footwear attachable apparatus of the present invention. Reference numeral 160 designates the center of rotation of a user's ankle. As shown in FIG. 16, each of the support members 124 comprise a base surface 126 and a top surface 169 which is affixed to the frame. The top surface 169 has a surface area which is greater than a surface area of the base surface 126. The support members 124 further include at least one upper side surface 165 and at least one tapered surface 166 between the base surface 126 and the upper side surface 165. The tapered surface 166 meets the base surface 126, and forms an interior support member edge 161, and an exterior support member edge 162, relative to the frame 122. As shown in FIG. 16, the user's footwear 164, has exterior edges 163, formed by the exterior and interior edges of the heel of the user's boot or shoe.

In one advantageous embodiment of the present invention, at least two of the plurality of support members 124 are affixed to the frame 122 in such a manner that the center of rotation 160 of the user's ankle is aligned with both the exterior edge 163 of the user's footwear and the support member exterior edge 162.

The alignment of the center rotation 160 of the user's ankle, the exterior edge 163 of the user's footwear, and the exterior edge 162 of the support member 124 is important for reasons of stability. Indeed, using the right foot viewed from behind as an example, the foot rotates about a center of rotation 160 in the ankle joint. Clockwise rotation of the right foot around this center rotation results in an aversion of the foot (the rolling under the smallest toe). Counter clockwise rotation results in eversion of the foot (the rolling up of the smallest toe). The physiology of the ankle offers excellent resistance evert the foot, but offers much less resistance to forces which would evert the foot. Forceful inversion is the condition in which most often results in a sprained ankle, although forceful eversion may also cause injury. When the foot is forcefully inverted, the foot and ankle may reach a position where they will no longer support the full weight of the body without significant pain. This results in the collapse of the legs, followed by the collapse of the individual to the ground.

The footwear attachable apparatus according to the present invention must safely support the user between one and three inches above the mesh, without, however, generating uncontrollable inversion or eversion forces. Improper design could result in great instability. If, for example, the device were to have four support members distributed in a rectangular fashion, without regard to the alignment of the center of rotation 160 of the user's ankle, the exterior edge of the user's footwear, and the exterior edge of the support frame 124, a footwear attachable apparatus would be less stable then the user's footwear with out the footwear attachable apparatus according to the present invention. Indeed, in such a case, if the lateral support members 124 were to come in contact with very soft material, while the medial support members 124 were in contact with very firm material, this condition could cause the user's foot to invert or to role under, resulting in loss of balance, collapse of the leg, and possible ankle injury.

The present invention, when configured properly, makes the system comprising the user's leg, ankle, foot, footwear, and the footwear attachable apparatus according to the present invention at least as stable as a bare foot against level ground. A line 168 extending from the center of rotation 160 of the ankle joint, through the exterior edge of the user's footwear to the exterior edge of the support member 124 results in greater stability to the user. A narrower foot, or a higher center of rotation in the ankle results in less stability.

In the present invention, the user's footwear, designated as reference numeral 164 in FIG. 16, has two edges 163 on each side of the footwear. If the edges 163 of the user's footwear intersect with the line 168 connecting the exterior edges 162 of the support member 124 with the center rotational 160 of the user's ankle, then the aggregate system will have a stability similar to that of a bare foot. If the edges 163 of the user's footwear fall inside of line 168, the stability of the aggregate system will be reduced. Alternatively, if the edges 163 of the user's footwear 164 fall outside of the lines 168, the stability of the aggregate system will be greater than that of a bare foot. In essence, the higher center of rotation of the ankle above the base surface 126, the further apart the support members 124 must be disposed, in order to achieve adequate stability.

Excellent results are obtained when boots are worn with the footwear attachable apparatus according to the present invention. The stiffness of the boot helps in providing additional resistance to inversion and eversion forces. By virtue of this stiffness, the distance separating the longitudinal axis 167 of the support members 124 could be narrower than the width determined by the alignment of the center rotation 160, the edge of the user's footwear 163, and the exterior edge 162 of the support member 124. Conversely, when used in conditions where the ground is less stable or has highly irregular topography, the footwear attachable apparatus of the present invention may require that the distance between the longitudinal axis of 167 of the support members 124 be greater than the width as determined by the lines 168.

FIG. 17 shows a fragmentary perspective exploded view of the footwear attachable apparatus according to the present invention. In FIG. 17, a spacer 116 is shown, which spacer 116 is removeably attachable to the strap securement member 118 via the spacer fasteners 115. The spacer fasteners 115 may be, for example, screws which engage in bores within the strap securement member 118, and engage corresponding threaded bores in the fasteners 116. FIG. 17 also depicts the support member 124 which is affixed to the top surface 119 in either a permanent, or detachable fashion. An attachment bracket 131 is disposed normal to the top surface 119 and integral with it, and attaches to the frame member 122. A cleat 114 is shown, which cleat 114 is removeably attached to the base surface 126 of the support member 124 by means of a screw member, or the like.

Figure 18:
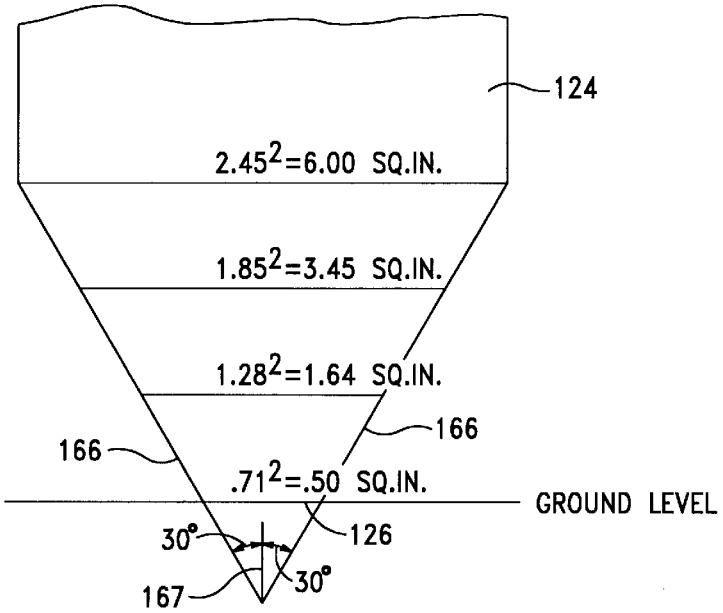
FIG. 18 is a schematic showing the varying cross-sectional areas of the support member at different floor penetration depths.

FIG. 18 shows a schematic representation of a support member 124. Shown in FIG. 18 are the base surface 126 which contacts the ground at ground level, the ground level being illustrated by the horizontal solid line. In the case wherein the support member 124 does not penetrate into the ground the user's weight will bear solely on the base surface 126 of each of the support members 124. In the illustrated embodiment of FIG. 18, the base surface 126 has a surface area of ½ square inch. As shown in FIG. 18, each of the tapered surfaces 166 of the support member 144 forms an angle relative to the longitudinal axis 167 of the support member 124, in the illustrated embodiment, this angle is substantially equal to 30°.

The following table shows the approximate depth to which the eight support members 124 (four such support members 124 on each footwear attachable apparatus according to the present invention, one such footwear attachable apparatus being secured to each foot) would sink into the soil of varying the floor bearing strengths when supporting one person weighing 150 lbs. and a second person weighing 200 lbs. The table below assumes that the angle of the tapered surface relative to the longitudinal axis 127 of the support member 124 is 30°, and that the base surface 126 has a surface area of ½ square inch.

| Penetration into the soil | Bearing surface per support member | Total bearing surface for 8 support members | Bearing strength of soil required to support 150 lb. person | Bearing strength of soil required to support 200 lb. person |
|---|---|---|---|---|
| 0 inches | .5 sq. in. | 4 sq. in. | 37.5 lbs./sq. in. | 50 lbs./sq. in |
| ½ inch | 1.64 sq. in. | 13.12 sq. in. | 11.5 lbs./sq. in. | 17.4 lbs./sq. in. |
| 1 inch | 3.45 sq. in. | 27.6 sq. in. | 5.4 lbs./sq. in. | 7.2 lbs./sq. in. |
| 1½ inches | 6.0 sq. in. | 48 sq. in. | 3.1 lbs./sq. in. | 4.1 lbs./sq. in. |

As can be seen from the above table, a person weighing 200 lbs. will be supported in fairly soft soil with a bearing strength approximately 7 lbs. per square inch with a penetration into the soil floor of approximately 1 inch.

It should be understood that the rate of increase in bearing surface area can be changed by varying the angle which the tapered surface forms relative to the longitudinal axis 127 of the support member 124.

As the support members 124 move down through the mesh and penetrate into the floor, they generate a lateral force vector which tends to separate the constituent elements of the mesh, and also generate a vertical (downward) force vector which would tend to crush the mesh elements. In practical applications, it has been found that if the angle formed by the tapered surface of the support member 124 and the longitudinal axis 127 is greater than about 30° or if the tapered surfaces together form an angle greater than about 60°, the ability of the support member 124 to penetrate and to separate the mesh without crushing it is compromised.

Figure 19:
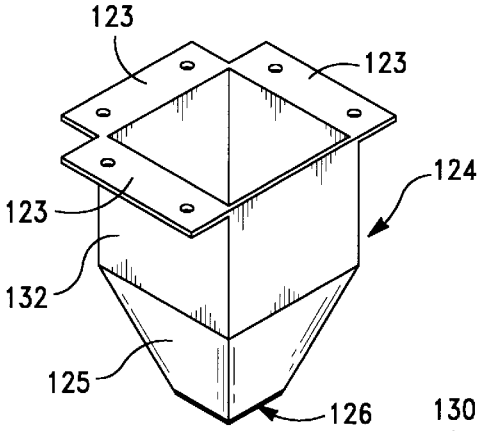
FIG. 19 is a perspective view of a variation of the support member shown in FIG. 17.
Figure 20:
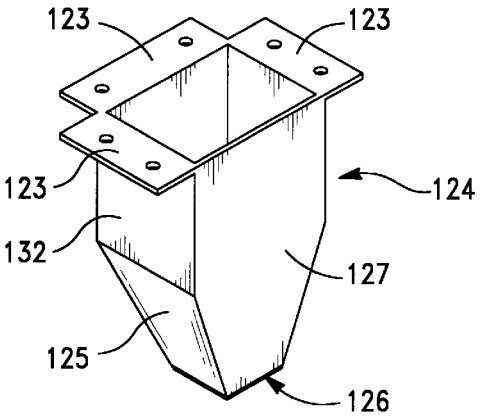
FIG. 20 is a perspective view of a variation of the support member shown in FIG. 17.
Figure 21:
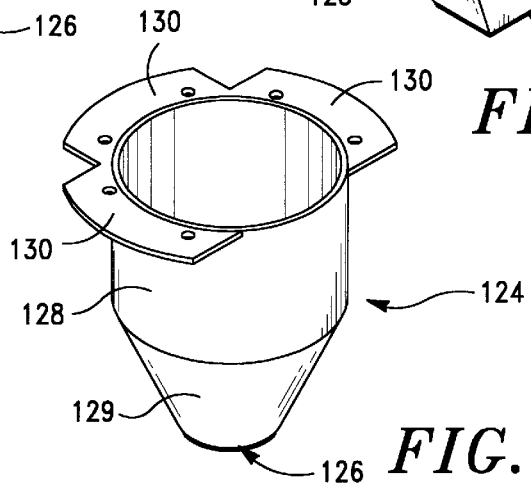
FIG. 21 is a perspective view of a variation of the support member shown in FIG. 17.

FIGS. 19 through 21 each show alternative embodiments of the support member 124. In FIG. 19, a support member 124 is shown comprising four orthogonal tapered surfaces 125 between the upper side surfaces 132 and the base surface 126. The configuration shown in FIG. 19 is the same as shown in FIGS. 13 and 15 through 17.

FIG. 20 shows another preferred embodiment of a support member 124. In FIG. 20, the support member 124 comprises three tapered surfaces 125, three upper side surfaces 132, and one planar surface 127 extending over the entire length of the support member 124.

FIG. 21 shows yet another embodiment of the support member 124. In FIG. 21, the support member comprises a single cylindrical upper side surface 128 and a single tapered surface 129 between the cylindrical upper side surface 128 and the cylindrical base surface 126. The tapered surface 129 thus forms a section of a cone between the cylindrical upper side surface 128 and the circular base surface 126.

In both FIGS. 19 and 20, the support members 124 comprise rectangular support member attachment brackets 123, whereas the support member 124 of FIG. 21 comprises three arcuate support member attachment brackets 130.

Of course, it will be apparent to those of skill in this art that many other shapes are possible and the embodiments pictured in FIGS. 7 through 11, and 19 through 20 are only representative examples, in all variations thereof are deemed to fall within the scope of the present invention.

The support members 124 may be made from any material which is resistant to the environment in which the footwear attachable apparatus according to the present invention is to be used. Such materials include, for example, corrosive resistant metals, plastics, or fiber composite materials. Moreover, the support members 124 may be attached to the top surface 119 by screws, spot welding techniques, rivets, or the like.

While the foregoing describes several embodiments of environmentally compatible footwear in accordance with this invention, it is to be understood that the above description is illustrative only and not limiting of the disclosed invention. It will be appreciated that it would be possible by one skilled in the art to modify a number of aspects of the footwear. For example, the shape and number of the support members can be changed. The surface area of the base and the top portions of the support members can change to accommodate soil conditions and the weight of a user. The shape of the tapered portion can change. Accordingly, the present invention is to be limited only by the claims as set forth below.

We claim:

1. Footwear attachable apparatus for modifying a footwear having a sole oriented substantially parallel to the bottom of a wearer's foot, the apparatus comprising:

a frame, the frame being attachable to a user's footwear;

a plurality of support members affixed to the frame for supporting the frame above ground, a support member axis being defined in each support member as being oriented substantially normal to the sole, each of the support members including:

a base surface;

a top surface fixed to the frame adjacent the sole, the top surface having a surface area greater than a surface area of the base surface;

at least one upper side surface; and at least one tapered surface between the base surface and the at least one upper side surface, the at least one tapered surface meeting the base surface and forming an interior and an exterior support member edge relative to the frame, the at least one tapered surface and the base surface together defining a weight-bearing surface of the support member, the weight-bearing surface bearing the weight of the wearer, the upper side surface defining a non-weight-bearing surface of the support member, the non-weight-bearing surface not bearing the weight of the wearer.

2. Apparatus as claimed in claim 1, wherein the upper side surface has a height, the at least one tapered surface is tapered at an angle relative to the support member axis, the angle having a magnitude at least sufficient to hold the frame at approximately the height of the upper side surface when the frame supports a determined weight on terrain of determined bearing strength.

3. Apparatus as claimed in claim 1, wherein each of said at least one tapered surface is tapered at an angle of about 30°, relative to the support member axis.

4. Apparatus as claimed in claim 1, wherein each of said at least one tapered surface is tapered at an angle, relative to the support member axis, said angle being selected as a function of a determined weight and a determined bearing strength of the terrain.

5. Apparatus as claimed in claim 1, wherein each of the at least one tapered surface is tapered at an angle, relative to the support member axis, the surface area of said base surface and the angle being selected such that the frame is supported above ground when the frame supports a determined weight on terrain of determined bearing strength.

6. Apparatus as claimed in claim 1, wherein each of said at least one tapered surface forms an angle relative to a longitudinal axis of a corresponding one of said plurality of support members, said area of said base surface and said angle being selected such that a product of a bearing strength of said ground and a sum of a cross sectional area, taken along said at least one tapered surface, of each of said plurality of support members, is at least equal to a user's weight, as said support member peneteates into the ground when said frame supports said user's weight, said cross sectional area corresponding to a cross sectional area of said support member immediately above ground and substantially parallel to said frame.

7. Apparatus as claimed in claim 1, wherein a number of said plurality of support members affixed to said frame is four.

8. Apparatus as claimed in claim 1, wherein said plurality of support members are removably affixed to said frame.

9. Apparatus as claimed in claim 1, further including at least one spacer, said at least one spacer being removably attachable to said to said frame and having a width sufficient to allow said user's footwear to be securely attached to said frame.

10. Apparatus as claimed in claim 1, wherein said frame comprises a front portion and a rear portion, said front portion and said rear portion being adjustably secured to one another by a plurality of fasteners to vary a length of said frame.

11. Apparatus as claimed in claim 1, wherein said base surface is rectangular in shape.

12. Apparatus as claimed in claim 1, wherein said base surface is substantially circular in shape.

13. Apparatus as claimed in claim 1, wherein said base surface is substantially semi-circular in shape.

14. Apparatus as claimed in claim 1, wherein said base surface has a trapezoidal shape.

15. Apparatus as claimed in claim 1, wherein said base surface has a triangular shape.

16. Apparatus according to claim 1, wherein said base surface has an arcuate periphery, and said at least one tapered surface has a curved surface.

17. Apparatus according to claim 16, wherein the arcuate periphery of the base surface defines at least a portion of an ellipse.

18. Apparatus as claimed in claim 1, wherein each of said plurality of support members comprises 4 tapered surfaces.

19. Apparatus as claimed in claim 1, wherein each of said plurality of support members comprises a single curved tapered surface, forming a conical section between said at least one upper side surface and said base surface.

20. Apparatus as claimed in claim 1, wherein said base surface includes a textured surface.

21. Apparatus according to claim 1, further comprising a plurality of cleats, each of said plurality of cleats being removably attached to a base surface of a corresponding one of said plurality of support members.

22. Apparatus according to claim 1, wherein said plurality of support members are made of a material selected from the group consisting of metal, plastic and fiber composite.

23. An apparatus as set forth in claim 1, attachable to a shoe having a sole having edges defining a width as measured directly beneath the wearer's ankle, wherein the support member axes defined by two support members define a segment passing directly beneath the center of rotation of the wearer's ankle, and a base surface of each of the same two support members comprises an outer edge, the distance between the outer edges of the support members being at least great enough that a segment drawn from the center of rotation of the wearer's ankle to each edge of the shoe sole approximates an outer edge of a support member, whereby, the lateral spacing of the support members provides enhanced lateral stability to the wearer's foot.

24. Footwear attachable apparatus for modifying a footwear having a sole oriented substantially parallel to the bottom of a wearer's foot, the apparatus comprising:

a frame, the frame being attachable to a user's footwear;

a plurality of support members affixed to the frame for supporting the frame above ground, each of the plurality of support members including:

a support member axis oriented substantially normal to the sole;

a base surface defining a cross-sectional area as projected onto a plane normal to the support member axis;

a top surface fixed to the frame proximate the sole;

at least one upper side surface; and at least one tapered surface between the base surface and the at least one upper side surface, the at least one tapered surface having a boundary and defining a cross-sectional area as projected onto a plane normal to the support member axis, the at least one tapered surface and the base surface together defining a surface of the support member, the weight-bearing surface bearing the weight of the wearer, the upper side surface defining a surface of the support member, the non-weight-bearing surface not bearing the weight of the wearer, each of the at least one tapered surface forming at least one angle relative to the support member axis, the surface area of the base surface and the angle being selected, and boundary of the tapered surface being defined, such that the combined cross-sectional areas of the base surfaces and the tapered surfaces attached to the frame equals a predetermined value.

25. Apparatus as claimed in claim 24, wherein the angle is about 30°.

26. Apparatus as claimed in claim 24, wherein the angle is selected as a function of a determined weight and a determined bearing strength of the terrain.

27. Apparatus as claimed in claim 24, wherein a number of said plurality of support members affixed to said frame is four.

28. Apparatus as claimed in claim 24, wherein said plurality of support members are removably affixed to said frame.

29. Apparatus as claimed in claim 24, further including at least one spacer, said at least one spacer being removably attachable to said to said frame and having a width sufficient to allow said user's footwear to be securely attached to said frame.

30. Apparatus as claimed in claim 24, wherein said frame comprises a front portion and a rear portion, said front portion and said rear portion being adjustably secured to one another by a plurality of fasteners to vary a length of said frame.

31. Apparatus as claimed in claim 24, wherein said base surface is rectangular in shape.

32. Apparatus as claimed in claim 24, wherein said base surface is substantially circular in shape.

33. Apparatus as claimed in claim 24, wherein said base surface is substantially semi-circular in shape.

34. Apparatus as claimed in claim 24, wherein said base surface has a trapezoidal shape.

35. Apparatus as claimed in claim 24, wherein said base surface has a triangular shape.

36. Apparatus according to claim 24, wherein said base surface has an arcuate periphery, and said at least one tapered surface has a curved surface.

37. Apparatus according to claim 36, wherein the arcuate periphery of the base surface defines at least a portion of an ellipse.

38. Apparatus as claimed in claim 24, wherein each of said plurality of support members comprises 4 tapered surfaces.

39. Apparatus as claimed in claim 24, wherein each of said plurality of support members comprises a single tapered curved surface, forming a conical section between said at least one upper side surface and said base surface.

40. Apparatus as claimed in claim 24, wherein said at least one tapered surface meets said base surface and forms an interior and an exterior support member edge relative to said frame, at least two of said plurality of support members being affixed to said frame such that a center of rotation of a user's ankle is aligned with both an edge of said user's footwear and said support member exterior edge.

41. Apparatus as claimed in claim 24, wherein said base surface includes a textured surface.

42. Apparatus according to claim 24, further comprising a plurality of cleats, each of said plurality of cleats being removably attached to a base surface of a corresponding one of said plurality of support members.

43. Apparatus according to claim 24, wherein said plurality of support members are made of a material selected from the group consisting of metal, plastic and fiber composite.

44. Apparatus as claimed in claim 24, wherein the frame defines inner and outer frame edges at a position along the length of the foot corresponding to the center of rotation of the wearer's ankle joint;

the base surfaces and tapered surfaces of a first and second support member define a first and second outer base edge, the first and second outer base edges being at opposite ends of a line segment passing directly beneath the wearer's ankle joint from left to right, the first and second outer base edges being spaced apart such that rays drawn from the center of rotation of the wearer's ankle joint through the inner and outer frame edges intersect the first and second outer base edges, respectively, whereby, the lateral spacing of the support members provides enhanced lateral stability to the wearer's foot.

45. Apparatus for quieting a shoe, the shoe having a bottom surface, the shoe to be worn by a person of known weight walking on a floor having a known bearing strength and a mesh layer of known thickness, the apparatus comprising:

a frame attachable to the shoe;

a plurality of downward-projecting support members fixed to the frame, each support member defining a central axis substantially normal to the bottom surface of the shoe and an origin on the central axis at the level of the bottom surface of the shoe, each support member defining at least one weight-bearing distal base surface, at least one weight-bearing medial side surface disposed between a distal base surface and the plane containing the origin and the bottom surface of the shoe, and at least one non-weight-bearing proximal side surface disposed between the medial side surface and the plane containing the origin and the bottom surface of the shoe, the distal base surface defining a base cross-sectional area as projected onto a plane normal to the central axis, the medial side surface defining a medial cross sectional area as projected onto a plane normal to the central axis, the medial side surface tapering toward the distal base surface, the proximal side surface defining a proximal cross-sectional area of essentially zero as projected onto a plane normal to the central axis, the proximal side surface having a height selected to be at least approximately as thick as the mesh layer, the distal base surface and the medial side surface being sized and angled such that the combined distal and medial cross-sectional areas of the plurality of support members attached to the shoe supports the full weight of the wearer, whereby, when the wearer steps on the mesh layer, the distal and medial surfaces of the support members quietly part and penetrate the mesh layer, and when the apparatus supports the full weight of the wearer, the bottom surface of the shoe sinks no closer to the floor than the approximate depth of the mesh layer, supporting the wearer while leaving the mesh layer relatively undisturbed.

46. An apparatus as set forth in claim 45, attachable to a shoe having a sole having edges defining a width as measured directly beneath the wearer's ankle, wherein the central axes defined by two support members define a segment passing directly beneath the center of rotation of the wearer's ankle, and the base surface of each of the same two support members comprises an outer edge, the distance between the outer edges of the support members being at least great enough that a segment drawn from the center of rotation of the wearer's ankle to each edge of the shoe sole approximates an outer edge of a support member, whereby, the lateral spacing of the support members provides enhanced lateral stability to the wearer's foot.

* * * * *